US008664874B2

(12) United States Patent
Kang et al.

(10) Patent No.: US 8,664,874 B2
(45) Date of Patent: Mar. 4, 2014

(54) BACKLIGHT UNIT AND APPARATUS AND METHOD FOR CONTROLLING LED DRIVING CIRCUIT

(75) Inventors: Jeong-il Kang, Yongin-si (KR); Tae-sung Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 101 days.

(21) Appl. No.: 13/460,135

(22) Filed: Apr. 30, 2012

(65) Prior Publication Data

US 2013/0033192 A1 Feb. 7, 2013

(30) Foreign Application Priority Data

Aug. 4, 2011 (KR) ..... 10-2011-0077881

(51) Int. Cl.
*H05B 37/02* (2006.01)

(52) U.S. Cl.
USPC ..... 315/224; 315/294; 315/307

(58) Field of Classification Search
USPC ..... 315/224, 291, 294, 307
See application file for complete search history.

(56) References Cited

U.S. PATENT DOCUMENTS

| | | | | |
|---|---|---|---|---|
| 2007/0024213 | A1 | 2/2007 | Shteynberg et al. | |
| 2009/0051296 | A1* | 2/2009 | Ball | 315/209 R |
| 2012/0081015 | A1* | 4/2012 | Shimomura et al. | 315/188 |
| 2012/0217894 | A1* | 8/2012 | Chang et al. | 315/265 |
| 2013/0082621 | A1* | 4/2013 | Kotowski et al. | 315/294 |
| 2013/0162154 | A1* | 6/2013 | Lee et al. | 315/200 R |

FOREIGN PATENT DOCUMENTS

WO 2005059964 A2 6/2005

OTHER PUBLICATIONS

Communication dated Dec. 7, 2012 from the European Patent Office in counterpart European application No. 12162665.9.

* cited by examiner

*Primary Examiner* — Don Le
(74) *Attorney, Agent, or Firm* — Sughrue Mion, PLLC

(57) ABSTRACT

A backlight unit is provided. The backlight unit includes an LED; an LED driving unit which drives the LED in accordance with a switching operation of a transistor; and a control unit which adds an additional signal to an output current of the LED to obtain a combined current, compares the combined current with the reference current, and controls the switching operation of the transistor based on the results of the comparison, wherein the additional signal is a current signal whose level increases over time in each period and is then reset to a predefined value in each period in accordance with an operation cycle of the transistor.

12 Claims, 8 Drawing Sheets

BACKLIGHT UNIT AND APPARATUS AND METHOD FOR CONTROLLING LED DRIVING CIRCUIT

CROSS-REFERENCE TO RELATED APPLICATION

This application claims priority from Korean Patent Application No. 10-2011-0077881, filed on Aug. 4, 2011, in the Korean Intellectual Property Office, the disclosure of which is incorporated herein by reference in its entirety.

BACKGROUND

1. Field

Apparatuses and methods consistent with the present disclosure relate to providing a backlight unit and an apparatus and method for controlling a light-emitting diode (LED) driving circuit, and more particularly, to providing a backlight unit using a light-emitting diode (LED) and an apparatus and method for controlling an LED driving circuit.

2. Description of the Related Art

Liquid crystal displays (LCDs) have been widely used because they are slim and light in weight, consume less power and require low driving voltages, as compared to other displays. However, LCDs do not emit light by themselves, and require additional backlight units to provide light to LCD panels thereof.

Cold cathode fluorescent lamps (CCFLs), light-emitting diodes (LEDs) and the like have been employed as backlight sources for LCDs. CCFLs use mercury and may cause pollution. In addition, CCFLs generally have the disadvantages of low response speed and poor color reproduction and may not be suitable for miniaturization.

LEDs do not use materials that may cause harm to the environment, and may thus be deemed eco-friendly. In addition, LEDs may be impulse-driven. Moreover, LEDs may provide excellent color reproducibility, have an ability to arbitrarily adjust brightness and color temperature by adjusting the amount of light emitted therefrom, and may be suitable for miniaturization. Therefore, LEDs have increasingly been employed as backlight sources for LCD panels.

In a typical boost-type LED driving circuit, a switching metal-oxide semiconductor (MOS) field-effect transistor (FET) may be connected to a ground. Thus, the boost-type LED driving circuit may be easy to be driven. In addition, a dimming MOSFET, which is also driven with the ground, may be added to an LED load terminal, thereby easily controlling the LED at high speed so as to provide high-resolution dimming.

However, the boost-type LED driving circuit requires LED-open protection and LED-short protection. In addition, due to the inherent characteristics of the boost-type LED driving circuit such as a requirement of a high input current, the manufacturing cost of the boost-type LED driving circuit may generally be high.

In a case in which high-resolution dimming is not required, the manufacturing cost of an LED driving circuit may be reduced by applying a low-side buck circuit not using a dimming MOSFET in a peak current control manner without any output current feedback. Peak current control is a technique of switching on a switching MOSFET at a uniform frequency and switching off the switching MOSFET in response to a sensed current reaching the same level as a reference current Iref.

However, this type of method may result in average LED output current fluctuations in case of any load variations or variations in input and output conditions, which is more apparent in a discontinuous conduction mode (DCM), in which a current through an inductor decreases to zero during a switching cycle, than in a continuous conduction mode (CCM), in which the current through the inductor never falls to zero during the switching cycle.

In addition, the CCM may be less suitable for use than the DCM because of its large MOSFET switching loss and a requirement of the use of an inductor with a high inductance.

SUMMARY

Exemplary embodiments of the present disclosure address at least the above problems and/or disadvantages and other disadvantages not described above. Also, the exemplary embodiments are not required to overcome the disadvantages described above, and an exemplary embodiment may not overcome any of the problems described above.

A backlight unit, an apparatus and method for controlling a light-emitting diode (LED) driving circuit are provided which are capable of reducing variations in an average LED output current with respect to variations in the properties of the elements of the backlight unit and the input and output conditions for the backlight unit.

According to an exemplary aspect, there is provided a backlight unit including: an LED; an LED driving unit which drives the LED in accordance with a switching operation of a transistor; and a control unit which adds an additional signal to an output current of the LED to obtain a combined current, compares the combined current with a reference current, and controls the switching operation of the transistor based on results of the comparison, wherein the additional signal is a current signal whose level increases over time in each period and is then reset in each period to a predefined value in accordance with an operation cycle of the transistor.

The control unit may include: an oscillator which generates a clock signal for periodically driving the transistor; an additional signal generation module which generates the additional signal in synchronization with the clock signal; a comparison module which receives the combined current and the reference current, and compares the combined current with the reference current; and a control signal output module which outputs a control signal for controlling the transistor based on the results of the comparison performed by the comparison module.

The LED driving unit may include a DC-to-DC converter which converts an input voltage into an LED driving voltage in accordance with an operation of the transistor, which is controlled by the control unit, and provides the LED driving voltage to the LED.

According to another exemplary aspect, there is provided an apparatus for controlling an LED driving circuit, the apparatus including: an oscillator which generates a clock signal for periodically driving a transistor in the LED driving circuit; an additional signal generation unit which generates an additional signal that is in synchronization with the clock signal, and adds the additional signal to a current that is used in the LED driving circuit to obtain a combined current; a comparison unit which compares the combined current with a reference current; and a control signal output unit which outputs a control signal for controlling the transistor based on results of the comparison performed by the comparison unit.

The additional signal is a current signal whose level increases over time in each period and is then reset to a predefined value in each period in accordance with an operation cycle of the transistor.

According to another exemplary aspect, there is provided a method of controlling an LED driving circuit, the method including: generating a clock signal for periodically driving a transistor in the LED driving circuit; generating an additional signal that is in synchronization with the clock signal; receiving the additional signal and a current that is used in the LED driving circuit; adding the additional signal and the current that is used in the LED driving circuit to obtain a combined current; comparing the combined current with a reference current; and outputting a control signal for controlling the transistor based on results of the comparing.

The additional signal is a current signal whose level increases over time in each period and is then reset to a predefined value in each period in accordance with an operation cycle of the transistor.

BRIEF DESCRIPTION OF THE DRAWINGS

The above and/or other aspects will be more apparent by describing certain exemplary embodiments with reference to the accompanying drawings, in which.

DETAILED DESCRIPTION

Figure 1:
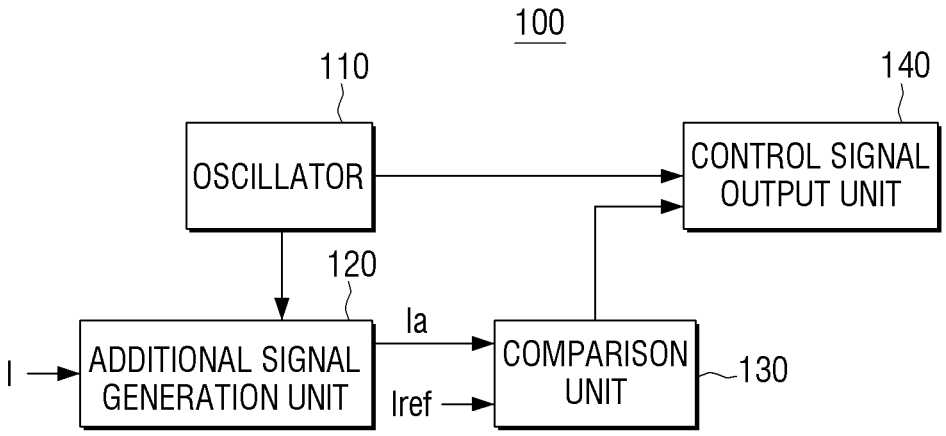
FIG. 1 is a block diagram of an apparatus for controlling a light-emitting diode (LED) driving circuit according to an exemplary embodiment.

Certain exemplary embodiments will now be described in greater detail with reference to the accompanying drawings.

In the following description, the same drawing reference numerals are used for the same elements even in different drawings. The matters defined in the description, such as detailed construction and elements, are provided to assist in a comprehensive understanding of the invention. Thus, it is apparent that the present invention can be carried out without those specifically defined matters. Also, well-known functions or constructions are not described in detail since they would obscure the invention with unnecessary detail.

FIG. 1 is a block diagram of an apparatus 100 for controlling a light-emitting diode (LED) driving circuit according to an exemplary embodiment. Referring to FIG. 1, the apparatus 100 includes an oscillator 110, an additional signal generation unit 120, a comparison unit 130, and a control signal output unit 140.

In the example illustrated in FIG. 1, an LED driving circuit (not shown) that may be controlled by the apparatus 100 may be a buck converter, and the apparatus 100 may generate a pulse-width modulation (PWM) signal for driving the buck converter.

The buck converter may be a circuit whose input and output terminals share the same ground source, and may include various types of elements such as, for example, a transistor, an inductor, a capacitor, a diode, and the like. The buck converter may drive an LED (not shown) by being switched on or off at regular intervals of time in response to the receipt of a PWM signal from an external source.

More specifically, in a case in which a transistor in the buck converter is switched on in response to a PWM signal, the buck converter may convert input power into an LED driving voltage, and may provide the LED driving voltage to the LED. In a case in which the transistor is switched off in response to a PWM signal, the buck converter may continue to provide input power stored in the inductor and the capacitor thereof to the LED during a time period (hereinafter, the "on" period) in which the transistor is switched on.

That is, the buck converter may adjust the brightness of the LED according to the duty cycle of a PWM signal.

The structure and operation of the buck converter are well-known to one of ordinary skill in the art, and thus, detailed descriptions thereof will be omitted.

The oscillator 110 may generate a clock signal for driving a transistor in the LED driving circuit periodically. More specifically, the oscillator 110 may generate a clock signal with a predefined frequency to switch on the transistor of the LED driving circuit at regular intervals of time.

The additional signal generation unit 120 may generate an additional signal in synchronization with the clock signal generated by the oscillator 110.

The additional signal may be a current signal that continues to increase and is then reset to a predefined value over the course of the operation of the transistor of the LED driving circuit.

More specifically, the additional signal may have the same period as the clock signal, which is generated by the oscillator 110, and may be a current signal whose level increases linearly or nonlinearly over time in each period. For example, the additional signal may be a ramp signal having the same period as the clock signal.

The additional signal generation unit 120 may add the additional signal to a current signal for use in the LED driving circuit.

For example, the term "current signal for use in the LED driving circuit" indicates, but is not limited to, a current that is output by the LED during the "on" period of the transistor of the LED driving circuit.

That is, the additional signal generation unit 120 may add the additional signal to the current output by the LED during the "on" period of the transistor of the LED driving circuit. Since the additional signal is a current signal whose level increases over time in each period, the longer the "on" period of the transistor of the LED driving circuit, the higher the current added to the output current of the LED.

The comparison unit 130 may compare a current $I_a$, which is obtained by adding the additional signal to the output current of the LED, with a reference current $I_{ref}$, and may transmit the results of the comparison to the control signal output unit 140.

The comparison unit 130 may be implemented as a typical comparator.

The control signal output unit 140 may output a control signal for the transistor of the LED driving circuit based on the results of the comparison performed by the comparison unit 130.

More specifically, the control signal output unit 140 may receive the clock signal from the oscillator 110, may receive the results of the comparison performed by the comparison unit 130, and may generate a PWM signal for driving the LED driving circuit based on the clock signal and the results of the comparison performed by the comparison unit 130.

That is, the control signal output unit 140 may switch on the transistor of the LED driving circuit at regular intervals of time in synchronization with the clock signal. In this example, if the current $I_a$ is higher than or the same as the reference current $I_{ref}$, the control signal output unit 140 may generate a PWM signal for switching off the transistor of the LED driving circuit.

The control signal output unit 140 may be implemented as a reset-set (RS) flip-flop that receives the clock signal as a set input and the output of the comparison unit 130 as a reset input.

Figure 2:
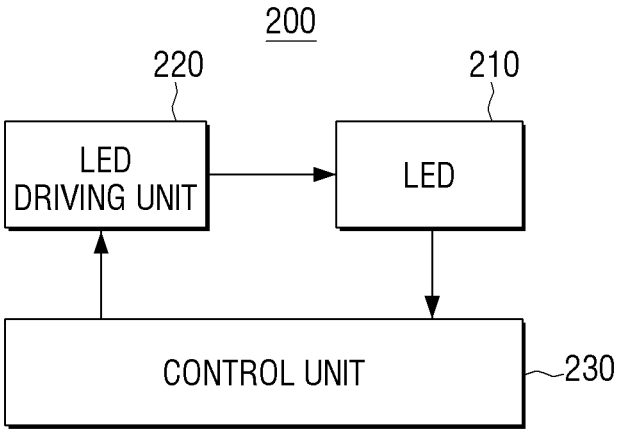
FIG. 2 is a block diagram of a backlight unit according to an exemplary embodiment.

FIG. 2 is a detailed block diagram of the backlight unit 200. Referring to FIG. 2, the backlight unit 200 includes an LED 210, an LED driving unit 220, and a control unit 230.

The LED 210 may emit light in response to a driving voltage being applied by the LED driving unit 220.

The brightness of the LED 210 may be determined by an average current provided by the LED driving unit 220.

The LED driving unit 220 may apply a driving voltage to the LED 210 under the control of the control unit 230.

More specifically, the LED driving unit 220 may convert an input voltage into a direct current (DC) voltage in accordance with the operation of a transistor that is controlled by the control unit 230, and may provide the DC voltage to the LED 210, which is connected to the LED driving unit 220 in parallel.

The LED driving unit 220 may be implemented as a buck converter, but there is no restriction to the type of device that may be used as the LED driving unit 220. For example, various types of DC-to-DC converters (such as, for example, a buck-boost converter or the like), other than a buck converter, may be used as the LED driving unit 220 as long as they may convert the input voltage into an LED driving voltage and may transmit the LED driving voltage to the LED 210.

The control unit 230 may add an additional signal to a current that is output by the LED 210, may compare a combined current obtained by adding the additional signal to the output current of the LED 210, and may control the switching operation of a transistor in the LED driving unit 220 based on the results of the comparison.

The control unit 230 may include an oscillator (not shown), an additional signal generation unit (not shown), a comparison unit (not shown), and a control signal output unit (not shown).

The oscillator may generate a clock signal for driving the transistor of the LED driving unit 220 periodically. More specifically, the oscillator may generate a clock signal with a predefined frequency to switch on the transistor of the LED driving unit 220 at regular intervals of time.

The additional signal generation unit may generate the additional signal in synchronization with the clock signal, which is generated by the oscillator.

The additional signal may be a current signal that continues to increase and is then reset to a predefined value over the course of the operation of the transistor of the LED driving unit 220.

More specifically, the additional signal may have the same period as the clock signal, which is generated by the oscillator, and may be a current signal whose level increases linearly or nonlinearly over time in each period. For example, the additional signal may be a ramp signal having the same period as the clock signal.

The additional signal generation unit may add the additional signal to a current signal for use in the LED driving unit 220.

For example, the term "current signal for use in the LED driving unit 220" indicates, but is not limited to, a current that is output by the LED during the "on" period of the transistor of the LED driving unit 220.

That is, the additional signal generation unit may add the additional signal to the current output by the LED during the "on" period of the transistor of the LED driving unit 220. Since the additional signal is a current signal whose level increases over time in each period, the longer the "on" period of the transistor of the LED driving unit 220, the higher the current added to the output current of the LED.

The comparison unit may compare a combined current obtained by adding the additional signal to the output current of the LED with a reference current, and may transmit the results of the comparison to the control signal output unit.

The control signal output unit may output a control signal for the transistor of the LED driving unit 220 based on the results of the comparison performed by the comparison unit.

That is, the control signal output unit may generate a PWM signal for controlling when to switch on or off the transistor of the LED driving unit 220 and may thus control an LED driving current that is applied to the LED 210 by the LED driving unit 220.

More specifically, the control signal output unit may drive the LED 210 by switching on the transistor of the LED driving unit 220 at regular intervals of time in synchronization with the clock signal. If the results of the comparison performed by the comparison unit indicate that the combined current is higher than or the same as the reference current, the control signal output unit may generate a PWM signal for switching off the transistor of the LED driving unit 220. The transistor may then be turned on via the PWM signal at the next clock "on" signal.

The control unit 230 may correspond to the apparatus 100 illustrated in FIG. 1. The operation of the control unit 230 is further described with reference to FIG. 3.

Figure 3:
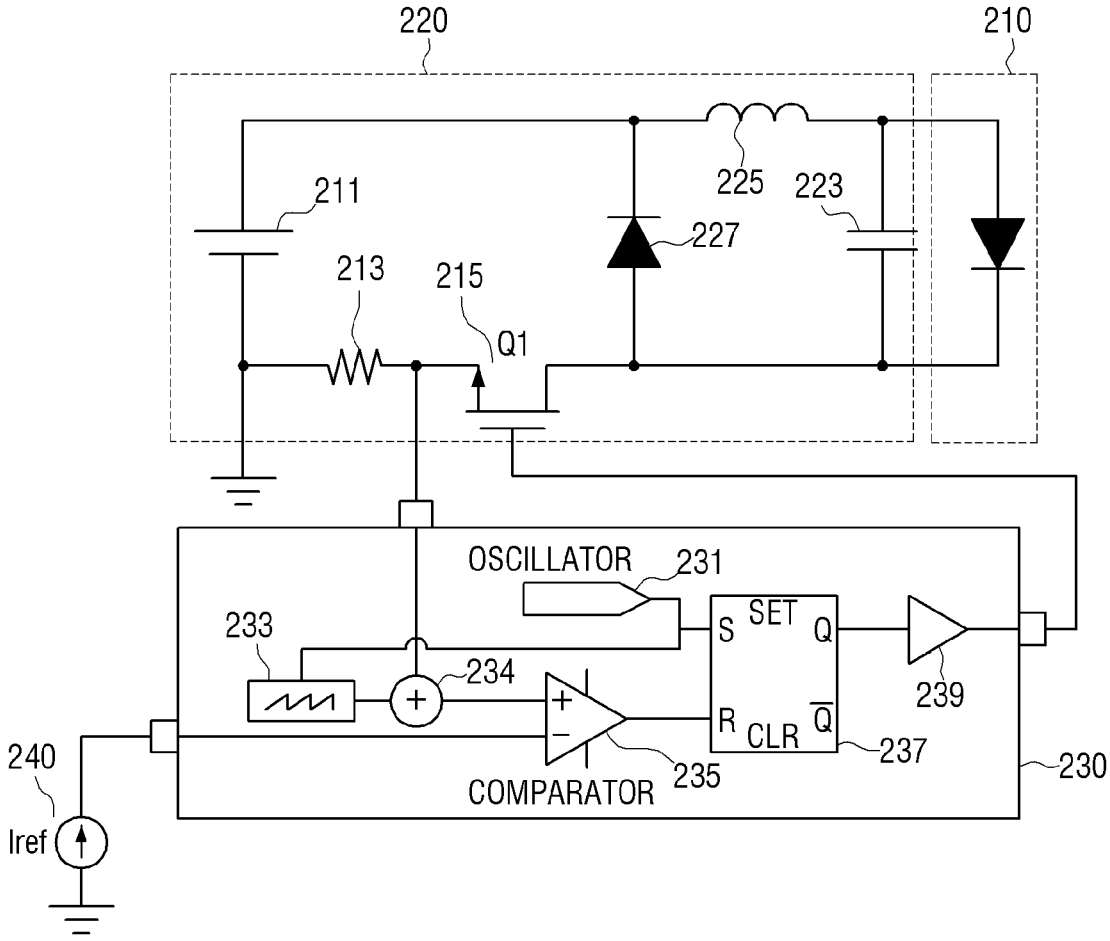
FIG. 3 is a circuit diagram of the backlight unit illustrated in FIG. 2.

FIG. 3 is a circuit diagram of the backlight unit 200.

Referring to FIG. 3, the backlight unit 200 includes the LED 210, the LED driving unit 220, and the control unit 230, and may receive a reference current 240 (i.e., $I_{ref}$) from an external source. The elements denoted by the same reference numerals as the elements in FIG. 2 have the same configurations and perform the same operations, and thus detailed descriptions thereof will not be reiterated.

The LED driving unit 220 may be implemented as a buck converter such as, for example, a low-side buck converter, which is a type of buck converter having a transistor disposed at a lower side thereof. The operation of the low-side buck converter will hereinafter be described.

In response to the receipt of a PWM signal from the control unit 230, a transistor 215 (Q1) may be turned on. Accordingly, an input voltage 211 ($V_i$) may be applied to a node between a first end of a diode 227 and a first end of an inductor 225.

Since the voltage applied to a second end of the inductor 225 is the same as an output voltage $V_o$ of the LED 210, a voltage corresponding to the difference between the input voltage $V_i$ and the output voltage $V_o$, i.e., $(V_i-V_o)$, may be applied to the inductor 225 so that a current may flow into the LED 210.

The amount (i.e., the slope) of the variation, over time, of the current flowing into the LED 210 may be defined by the following equation: $(V_i-V_o)/L$ where L denotes the inductance of the inductor 225.

In a case in which the transistor 215 is switched off in response to the receipt of a PWM signal from the control unit 230, a current may flow into the LED 210 in accordance with the output voltage $V_o$, which is applied to the second end of the inductor 225.

When a forward voltage (i.e., a turn-on voltage) of the diode 227 is ignored, the voltage applied to the first end of the diode 227 may be the same as a ground voltage GND. Accordingly, the amount of the variation, over time, of the current flowing into the LED 210, and more particularly, into the inductor 225, may be defined by the following equation: $-(V_o)/L$.

A PWM signal for controlling the operation of the LED driving unit 220 may be generated by the control unit 230. The control unit 230 may include an oscillator 231, an additional signal generation unit 233, a comparison unit 235, a control signal output unit 237, and an amplification unit 239.

The oscillator 231 may generate a clock signal with a predefined frequency to periodically switch on or off the transistor 215. The oscillator 231 may transmit the clock signal to the additional signal generation unit 233 and the control signal output unit 237.

The additional signal generation unit 233 may generate an additional signal in synchronization with the clock signal, and may add the additional signal to a current that is output by the LED 210. The additional signal generation unit 233 may include a ramp signal generator 233 and an adder 234.

The ramp signal generator 233 may generate a ramp signal as the additional signal, and may transmit the ramp signal to the adder 234. The ramp signal may have the same period as the clock signal, and the level of the ramp signal may increase linearly over time in each period. That is, in one period, the level of the ramp signal increases during an "on" time, and is reset to a predefined value during an "off" time for each period.

The adder 234 may receive an output current of the LED 210 via a node between the source of the transistor 215 and the resistor 213, may receive the additional signal from the ramp signal generator 233, and may add the output current of the LED 210 and the additional signal.

The adder 234 may receive the output current of the LED 210 from the source of the transistor 215. More specifically, adder 234 may receive the output current of the LED 210 in a case in which the transistor 215 is switched on.

The additional signal may be a ramp signal, i.e., a type of current whose level increases over time in each period. Therefore, the longer the "on" period of the transistor 215, the higher the current added to the output current of the LED 210.

The comparison unit 235 may compare a combined current obtained by adding the additional signal to the output current of the LED 210 with the reference current 240, and may transmit the results of the comparison to the control signal output unit 140 illustrated in FIG. 1. For example, if the combined current is higher than or the same as the reference current 240, the comparison unit 235 may output a logic high signal.

The control signal output unit 237 may be implemented as an RS flip-flop, and may receive the clock signal as a set input S and the output of the comparison unit 130 as a reset input R.

For example, in response to the clock signal being received as the set input S, the control signal output unit 237 may generate a PWM signal for periodically switching on the transistor 215. Furthermore, in response to a logic high signal being received from the comparison unit 235 as the reset input R, the control signal output unit 237 may generate a PWM signal for switching off the transistor 215.

In short, the control signal output unit 237 may generate a PWM signal for switching on or off the transistor 215.

The amplification unit 239 may amplify a PWM signal that is output by the control signal output unit 237, and may transmit the amplified PWM signal to the transistor 215.

In the example illustrated in FIG. 3, the backlight unit 200 may add an additional signal to the output current of the LED 210 during the "on" period of the transistor 215, and may switch off the transistor 215 in response to a combined current obtained by adding the additional signal to the output current of the LED 210 reaching the same level as the reference current 240. Since the additional signal is a current signal whose level increases over time during the "on" period of the transistor 215, the longer the "on" period of the transistor 215, the higher the current added to the output current of the LED 210.

According to the examples illustrated in FIGS. 2 and 3, it is possible to provide a backlight unit capable of reducing any variations in an average LED output current that may be caused by variations in the properties of the elements (such as, for example, an inductor) of a backlight unit and the input and output voltages for a backlight unit.

The properties of the operation of a backlight unit according to an exemplary embodiment are further described with reference to FIGS. 4A to 8B.

For example, referring to FIGS. 4A to 8B, assume, for both a backlight unit (for example, the backlight unit 200) according to an exemplary embodiment of the present disclosure and a related-art backlight unit, that the "on" period of a transistor of an LED driving unit (i.e., the period of a clock signal generated by an oscillator) is T, that the inductance of an inductor of the LED driving unit is L, and that the input and output voltages of the LED driving unit are $V_i$ and $V_o$, respectively.

As described above with reference to FIG. 3, the amount of the variation, over time, of a current that flows in the inductor of an LED driving unit when the transistor of the LED driving unit is on may be defined as $(V_i-V_o)/L$, and the amount of the variation, over time, of a current that flows in the inductor of the LED driving unit when the transistor of the LED driving unit is off may be defined as $-(V_o)/L$.

Figure 4A:
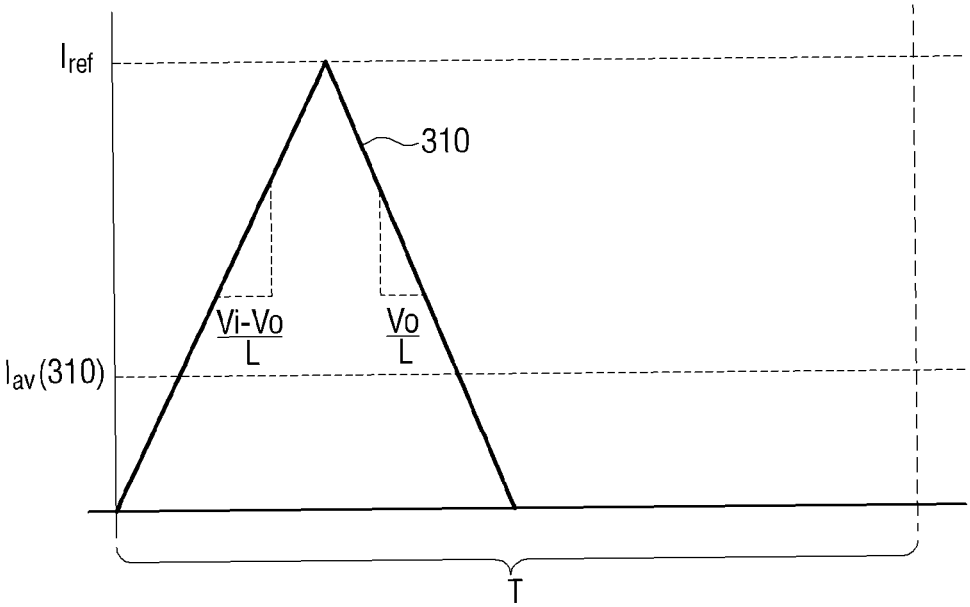
FIG. 4A (RELATED ART)
FIGS. 4A to 8B are waveform diagrams for comparing the LED output current of a related-art backlight assembly and the LED output current of a backlight unit according to an exemplary embodiment.
Figure 4B:
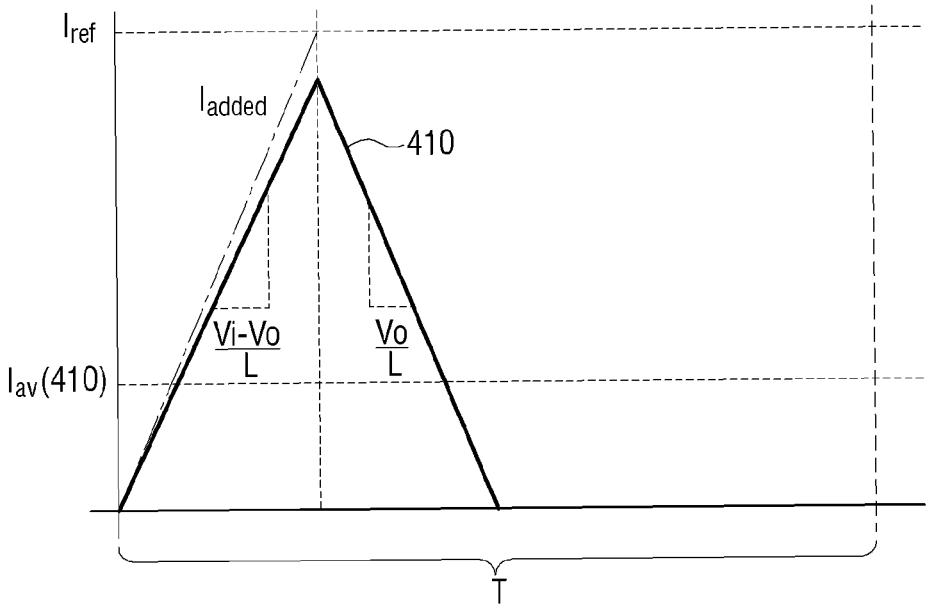

FIG. 4A illustrates the LED output current of the related-art backlight unit, and FIG. 4B illustrates the LED output current of the backlight unit 200 of an exemplary embodiment of the present disclosure, in a case in which the input and output voltages $V_i$ and $V_o$ and the properties of the elements of each of the backlight unit 200 and the related-art backlight unit remain unchanged.

Referring to FIG. 4A, in a case in which the transistor of an LED driving unit of the related-art backlight unit is switched on, an LED output current 310 of the related-art backlight unit with an average $I_{av}$(310) gradually increases with a slope of $(V_i-V_o)/L$. In response to the LED output current 310 reaching the same level as the reference current $I_{ref}$, the transistor of the LED driving unit of the related-art backlight unit is switched off so that the LED output current 310 gradually decreases with a slope of $-(V_o)/L$.

Alternatively, the backlight unit 200 may add an additional signal to an LED output current and may switch off the transistor 215 in response to a combined current $I_{added}$ obtained by the adding the additional signal to the LED output current reaching the same level as the reference current 240, instead of switching off the transistor 215 in response to the LED output current 410 reaching the same level as the reference current 240. For example, the additional signal may be a ramp signal whose level increases over time.

Accordingly, referring to FIG. 4B, the amount of the variation, over time, of the combined current $I_{added}$ may become greater than $(V_i-V_o)/L$, and thus, the combined current $I_{added}$ may reach the same level as the reference current $I_{ref}$ earlier than the LED output current 310 of FIG. 4A.

As a result, an LED output current 410 of the backlight unit 200 may be lower than the reference current $I_{ref}$ at a time when the combined current $I_{added}$ reaches the same level as the reference current $I_{ref}$.

Therefore, referring to FIGS. 4A and 4B, an average LED output current $I_{av}$(410) of the backlight unit 200 may be lower than the average LED output current $I_{av}$(310) of the related-art backlight unit.

Figure 5A:
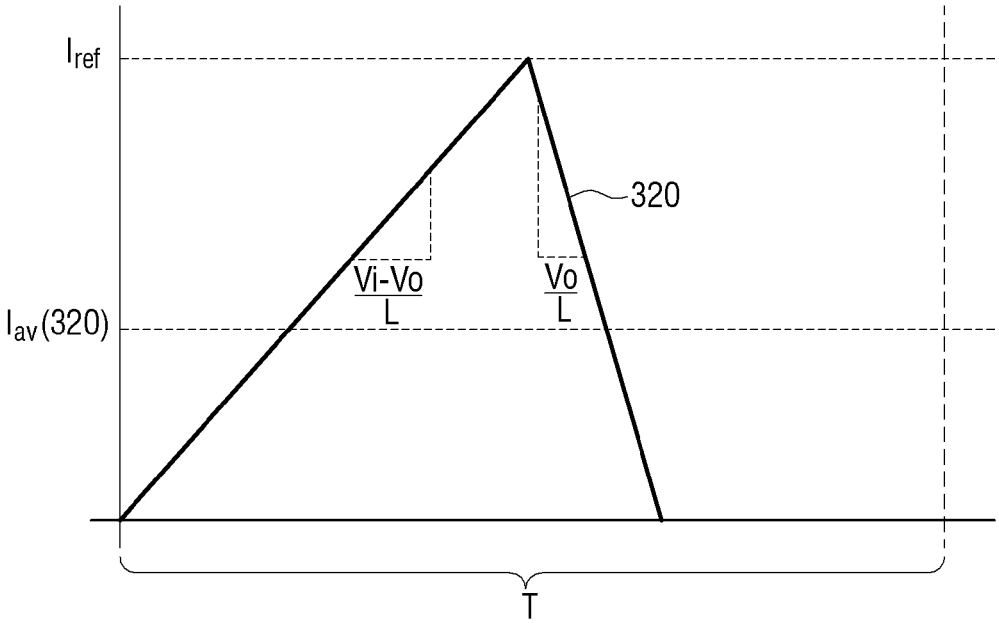
FIG. 5A (RELATED ART)
Figure 5B:
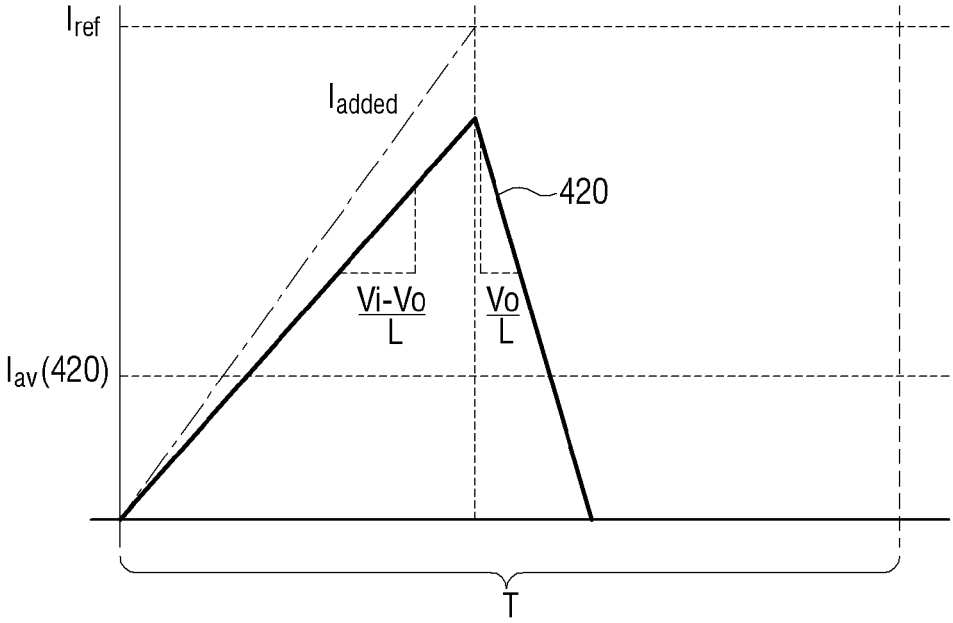

FIG. 5A illustrates the LED output current of the related-art backlight unit, and FIG. 5B illustrates the LED output current of the backlight unit 200, in a case in which the output voltage $V_o$ increases.

As the output voltage $V_o$ increases, the amount of the variation, over time, of a current that flows in the inductor of the LED driving unit of the related-art backlight unit when the transistor of the corresponding LED driving unit is on, i.e., $(V_i-V_o)/L$, may decrease, and the amount of the variation, over time, of a current that flows in the inductor of the LED driving unit of the related-art backlight unit when the transistor of the corresponding LED driving unit is off, i.e., $-(V_o)/L$, may increase.

Referring to FIG. 5A, as the output voltage $V_o$ increases, the slope of the variation of an LED output current 320 of the related-art backlight unit with an average $I_{av}$(320) during the "on" period of the transistor of the LED driving unit of the related-art backlight unit may decrease, as compared to FIG. 4A, and, as a result, the length of the "on" period of the transistor of the LED driving unit of the related-art backlight unit may increase.

Therefore, the average LED output current $I_{av}$(320) may be higher than the average LED output current $I_{av}$(310) of FIG. 4A.

Alternatively, the backlight unit 200 may add an additional signal to an LED output current, and may switch off the transistor 215 in response to a combined current $I_{added}$ obtained by adding the additional signal to the LED output current reaching the same level as the reference current $I_{ref}$. The additional signal may be a ramp signal whose level increases over time.

Accordingly, referring to FIG. 5B, the amount of the variation, over time, of the combined current $I_{added}$ may become greater than $(V_i-V_o)/L$, and thus, the combined current $I_{added}$ may reach the same level as the reference current $I_{ref}$ earlier than the LED output current 320 of FIG. 5A.

As a result, an LED output current 420 of the backlight unit 200 may be lower than the reference current $I_{ref}$ at a time when the combined current $I_{added}$ reaches the same level as the reference current $I_{ref}$.

Therefore, an average LED output current $I_{av}$(420) of the backlight unit 200 may be higher than the average LED output current $I_{av}$(410) of FIG. 4B.

Referring to FIGS. 4A to 5B, the difference between the average LED output current $I_{av}$(420) and the average LED output current $I_{av}$(410) may be less than the difference between the average LED output current $I_{av}$(320) and the average LED output current $I_{av}$(310). That is, the backlight unit 200 may provide a more stable average LED output current than the related-art backlight unit regardless of a variation in the output voltage $V_o$.

Figure 6A:
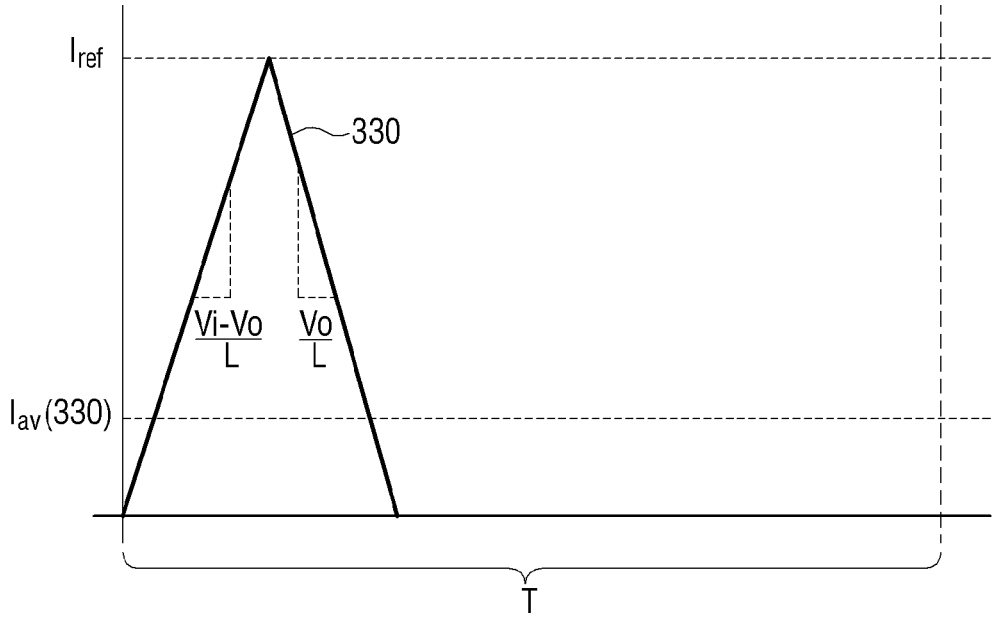
FIG. 6A (RELATED ART)
Figure 6B:
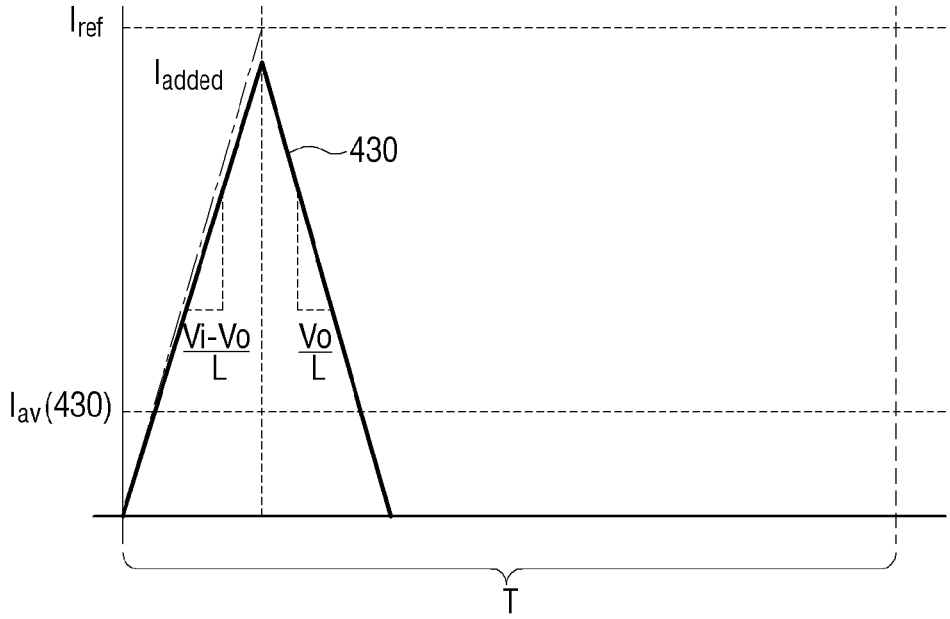

FIG. 6A illustrates the LED output current of the related-art backlight unit, and FIG. 6B illustrates the LED output current of the backlight unit 200, in a case in which the inductance L decreases.

As the inductance L decreases, the amount of the variation, over time, of a current that flows in the inductor of the LED driving unit of the related-art backlight unit when the transistor of the corresponding LED driving unit is on, i.e., $(V_i-V_o)/L$, may increase, and the amount of the variation, over time, of a current that flows in the inductor of the LED driving unit of the related-art backlight unit when the transistor of the corresponding LED driving unit is off, i.e., $-(V_o)/L$, may also increase.

Referring to FIG. 6A, an LED output current 330 of the related-art backlight unit with an average $I_{av}$(330) may increase with a steeper slope than the LED output current 310, and thus, the "on" period of the transistor of the LED driving unit of the related-art backlight unit may decrease.

Therefore, the output LED output current $I_{av}$(330) may be lower than the average LED output current $I_{av}$(310) of FIG. 4A.

Alternatively, the backlight unit 200 may add an additional signal to an LED output current, and may switch off the transistor 215 in response to a combined current $I_{added}$ obtained by adding the additional signal to the LED output current reaching the same level as the reference current $I_{ref}$. The additional signal may be a ramp signal whose level increases over time.

Accordingly, referring to FIG. 6B, the amount of the variation, over time, of the combined current $I_{added}$ may become greater than $(V_i-V_o)/L$, and thus, the combined current $I_{added}$ may reach the same level as the reference current $I_{ref}$ earlier than the LED output current 330 of FIG. 6A.

As a result, an LED output current 430 of the backlight unit 200 may be lower than the reference current $I_{ref}$ at a time when the combined current $I_{added}$ reaches the same level as the reference current $I_{ref}$.

Therefore, an average LED output current $I_{av}$(430) of the backlight unit 200 may be lower than the average LED output current $I_{av}$(410) of FIG. 4B.

Referring to FIGS. 4A, 4B, 6A, and 6B, the difference between the average LED output current $I_{av}$(430) and the average LED output current $I_{av}$(410) may be less than the difference between the average LED output current $I_{av}$(330) and the average LED output current $I_{av}$(310). That is, the backlight unit 200 may provide a more stable average LED output current than the related-art backlight unit regardless of variations in the properties of the elements thereof.

Figure 7A:
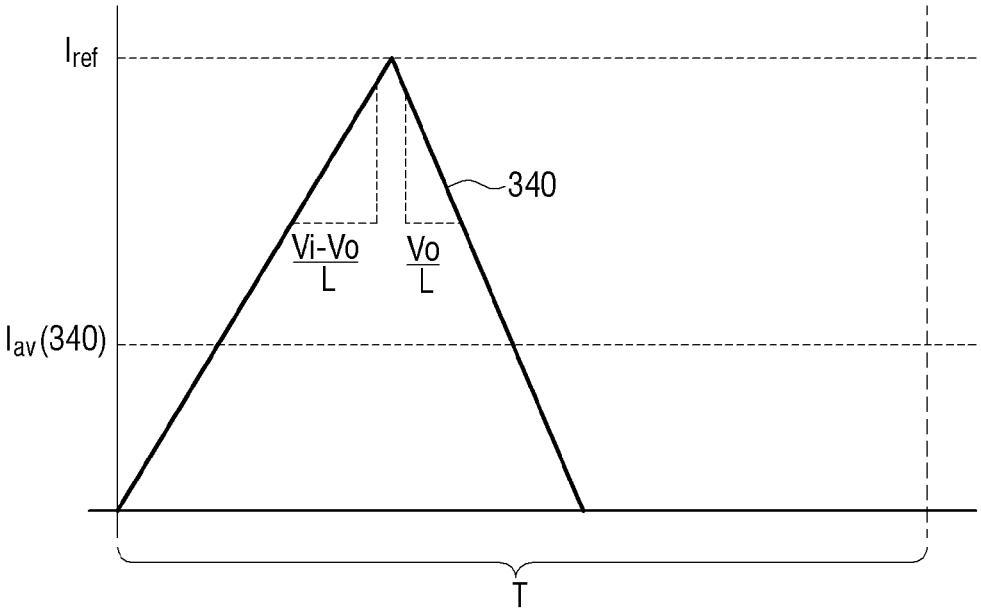
FIG. 7A (RELATED ART)
Figure 7B:
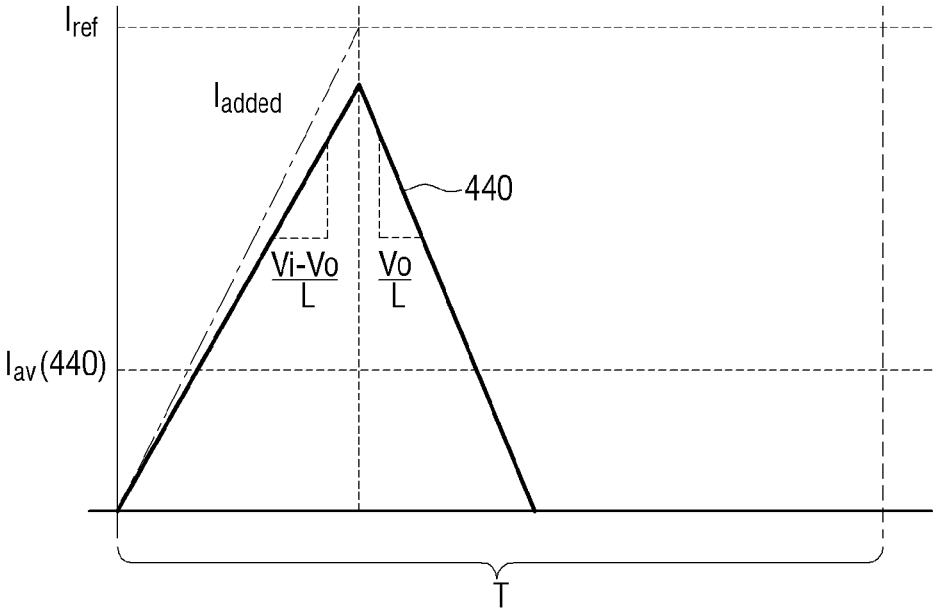

FIG. 7A illustrates the LED output current of the related-art backlight unit, and FIG. 7B illustrates the LED output current of the backlight unit 200, in a case in which the input voltage $V_i$ decreases.

As the input voltage $V_i$ increases, the amount of the variation, over time, of a current that flows in the inductor of the LED driving unit of the related-art backlight unit when the transistor of the corresponding LED driving unit is on, i.e., $(V_i-V_o)/L$, may decrease.

Referring to FIG. 7A, as the input voltage $V_i$ increases, the slope of the variation of an LED output current 340 of the related-art backlight unit with an average $I_{av}$(340) during the "on" period of the transistor of the LED driving unit of the related-art backlight unit may decrease, as compared to FIG. 4A, and, as a result, the length of the "on" period of the transistor of the LED driving unit of the related-art backlight unit may increase.

Therefore, the average LED output current $I_{av}$(340) of the backlight unit 200 may be higher than the average LED output current $I_{av}$(410) of FIG. 4B.

Alternatively, the backlight unit 200 may add an additional signal to an LED output current, and may switch off the transistor 215 in response to a combined current $I_{added}$ obtained by adding the additional signal to the LED output current reaching the same level as the reference current $I_{ref}$. The additional signal may be a ramp signal whose level increases over time.

Accordingly, referring to FIG. 7B, the amount of the variation, over time, of the combined current $I_{added}$ may become greater than $(V_i-V_o)/L$, and thus, the combined current $I_{added}$ may reach the same level as the reference current $I_{ref}$ earlier than the LED output current 340 of FIG. 7A.

As a result, an LED output current 440 of the backlight unit 200 may be lower than the reference current $I_{ref}$ at a time when the combined current $I_{added}$ reaches the same level as the reference current $I_{ref}$.

Therefore, an average LED output current $I_{av}$(440) of the backlight unit 200 may be higher than the average LED output current $I_{av}$(410) of FIG. 4B.

Referring to FIGS. 4A, 4B, 7A, and 7B, the difference between the average LED output current $I_{av}$(440) and the average LED output current $I_{av}$(410) may be less than the difference between the average LED output current $I_{av}$(340) and the average LED output current $I_{av}$(310). That is, the backlight unit 200 may provide a more stable average LED output current than the related-art backlight unit regardless of variations in the properties of the elements thereof.

Figure 8A:
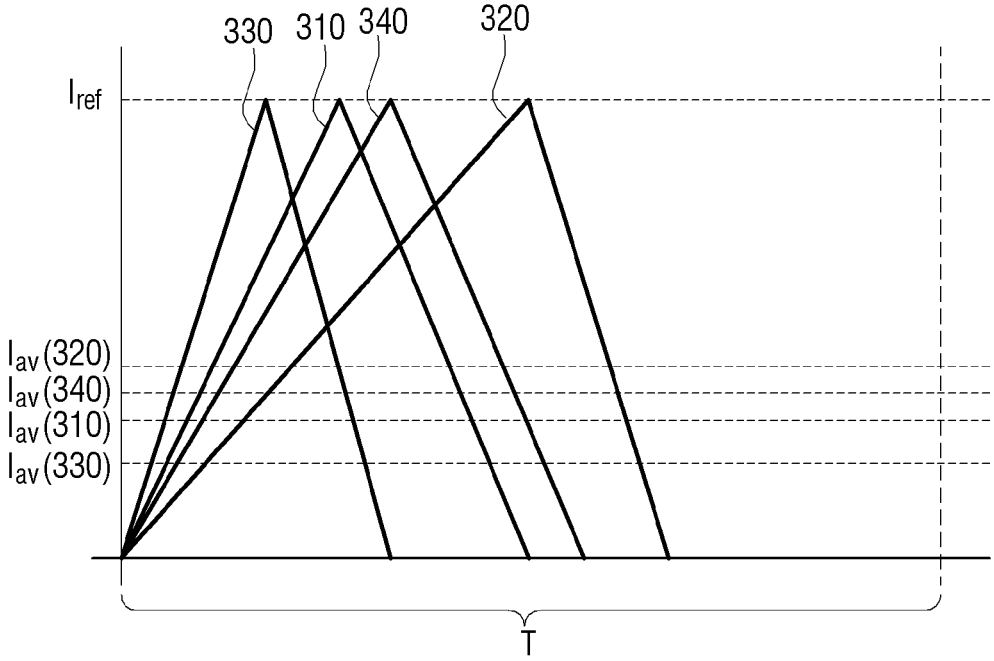
FIG. 8A (RELATED ART)
Figure 8B:
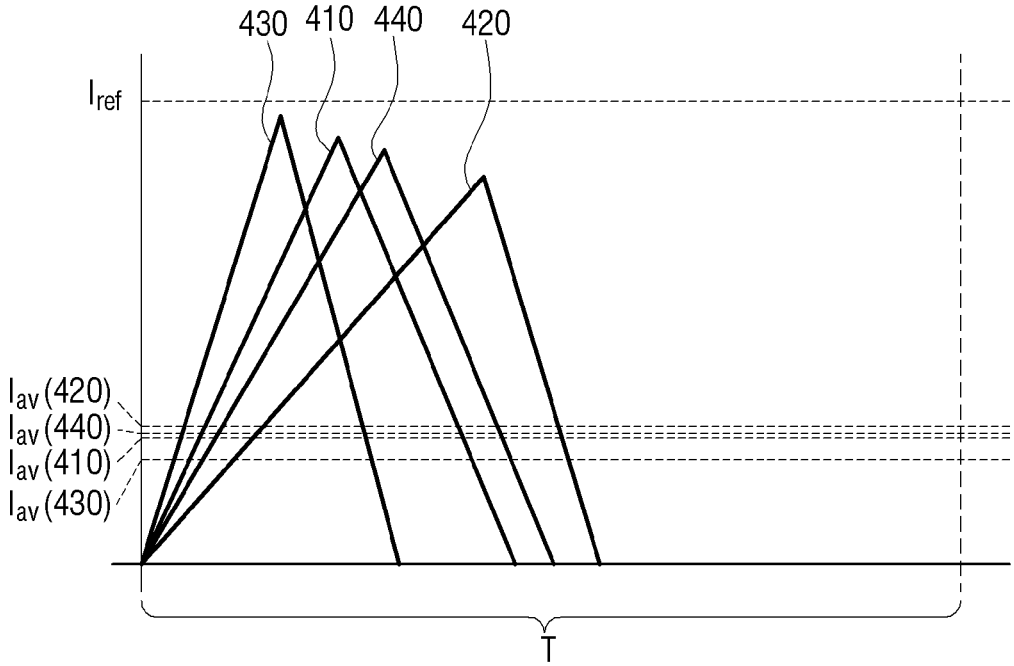

FIGS. 8A to 8B are waveform diagrams for comparing the characteristics of the variation of the LED output current of the related-art backlight unit as illustrated in FIGS. 4A, 5A, 6A, and 7A with the characteristics of the variation of the LED output current of the backlight unit 200 as illustrated in FIGS. 4B, 5B, 6B, and 7B.

Referring to FIG. 8A, the average LED output current $I_{av}$(310), which is the average output current of the related-art backlight unit when there are no changes in the input and output voltages $V_i$ and $V_o$ and the properties of the elements of the related-art backlight unit, the average LED output current $I_{av}$(320), which is the average LED output current of the related-art backlight unit when the output voltage $V_o$ decreases, the average LED output current $I_{av}$(330), which is the average LED output current of the related-art backlight unit when the inductance L decreases, and the average LED output current $I_{av}$(340), which is the average LED output current of the related-art backlight unit when the input voltage $V_i$ decreases, greatly vary from one another.

On the other hand, referring to FIG. 8B, the average LED output current $I_{av}$(410), which is the average output current of the backlight unit 200 when there are no changes in the input and output voltages $V_i$ and $V_o$ and the properties of the elements of the backlight unit 200, the average LED output current $I_{av}$(420), which is the average LED output current of the backlight unit 200 when the output voltage $V_o$ decreases, the average LED output current $I_{av}$(430), which is the average LED output current of the backlight unit 200 when the inductance L decreases, and the average LED output current $I_{av}$(340), which is the average LED output current of the backlight unit 200 when the input voltage $V_i$ decreases, vary from one another, but less greatly than their respective counterparts of FIG. 8A.

As described above with reference to FIGS. 4A to 8B, the backlight unit 200 may reduce any variations in the average LED output current thereof regardless of variations in input and output voltages or in the properties of the elements of the backlight unit 200. Therefore, it is possible to provide a backlight unit robust against variations in input and output voltages or the properties of the elements thereof.

Figure 9:
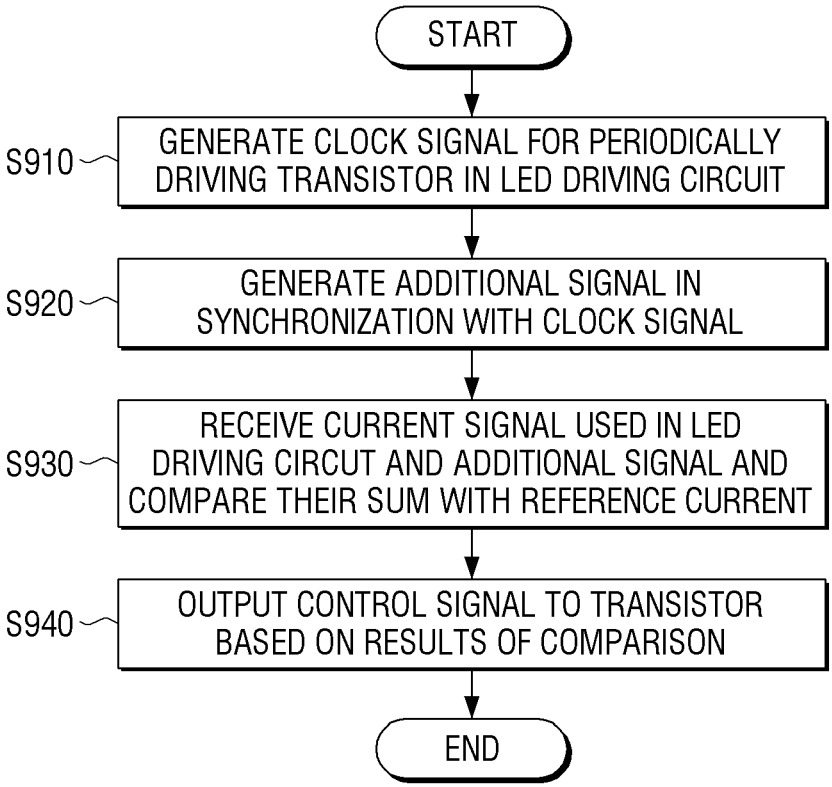
FIG. 9 is a flowchart illustrating a method of driving an LED driving circuit according to an exemplary embodiment.

FIG. 9 is a flowchart illustrating a method of controlling an LED driving circuit according to an exemplary embodiment.

Referring to FIG. 9, in S910, a clock signal for periodically driving a transistor in an LED driving circuit may be generated.

In S920, an additional signal may be generated in synchronization with the clock signal. The additional signal may be a current signal whose level increases over time and is reset to a predefined value in accordance with the operation cycle of the transistor.

In S930, a current that is used in the LED driving circuit and the additional signal may be added together, and their sum may be compared with a reference current.

In S940, a control signal for controlling the transistor may be output based on the results of the comparison performed in S930.

For example, in a case in which the results of the comparison performed in S930 indicate that a combined current obtained by adding the additional signal to the current used in the LED driving circuit is higher than the reference signal, a PWM signal for switching off the transistor may be generated.

According to the example illustrated in FIG. 9, it is possible to provide a robust LED driving circuit by using a low-cost, high-efficiency discontinuous conduction mode (DCM) buck method without a requirement of any output current feedback.

In addition, it is possible to provide a hybrid backlight unit equipped with a metal-oxide semiconductor (MOS) FET (MOSFET).

The processes, functions, methods, and/or software described herein may be recorded, stored, or fixed in one or more computer-readable storage media that includes program instructions to be implemented by a computer to cause a processor to execute or perform the program instructions. The media may also include, alone or in combination with the program instructions, data files, data structures, and the like. The media and program instructions may be those specially designed and constructed, or they may be of the kind well-known and available to those having skill in the computer software arts. Examples of computer-readable storage media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules that are recorded, stored, or fixed in one or more computer-readable storage media, in order to perform the operations and methods described above, or vice versa. In addition, a computer-readable storage medium may be distributed among computer systems connected through a network and computer-readable codes or program instructions may be stored and executed in a decentralized manner.

As described above, it is possible to provide a backlight unit and an apparatus and method for controlling the backlight unit, which can reduce variations in an average LED output current with respect to variations in the input and output conditions for the backlight unit and the properties of the elements of the backlight unit.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A backlight unit comprising:

a light-emitting diode (LED);

an LED driving unit which drives the LED in accordance with a switching operation of a transistor; and a control unit which adds an additional signal to an output current of the LED to generate a combined current, compares the combined current with a reference current in a comparison, and controls the switching operation of the transistor based on a result of the comparison, wherein the additional signal is a current signal whose level increases over time in a period and is then reset in the period to a predefined value for each period of a plurality of periods in accordance with an operation cycle of the transistor.

2. The backlight unit of claim 1, wherein the control unit comprises:

an oscillator which generates a clock signal for periodically driving the transistor;

an additional signal generation module which generates the additional signal in synchronization with the clock signal;

a comparison module which receives the combined current and the reference current, and compares the combined current with the reference current; and a control signal output module which outputs a control signal for controlling the transistor based on the result of the comparison performed by the comparison module.

3. The backlight unit of claim 1, wherein the LED driving unit comprises:

a DC-to-DC converter which converts an input voltage into an LED driving voltage in accordance with an operation of the transistor, which is controlled by the control unit, and provides the LED driving voltage to the LED.

4. The backlight unit of claim 2, wherein the additional signal increases over time during an on period of the clock signal, and the additional signal is reset to the predefined value during an off period of the clock signal.

5. The backlight unit of claim 4, wherein, if the combined current is equal to or greater than the reference current, the control signal output module outputs an off control signal which turns off the transistor.

6. The backlight unit of claim 5, wherein the control signal output module outputs an on control signal at each on period of a plurality of on periods of the clock signal which turn on the transistor.

7. An apparatus for controlling an LED driving circuit, the apparatus comprising:

an oscillator which generates a clock signal for periodically driving a transistor in the LED driving circuit;

an additional signal generation unit which generates an additional signal that is in synchronization with the clock signal, and adds the additional signal to a current that is used in the LED driving circuit to generate a combined current;

a comparison unit which compares the combined current with a reference current in a comparison; and a control signal output unit which outputs a control signal for controlling the transistor based on a result of the comparison performed by the comparison unit.

8. The apparatus of claim 7, wherein the additional signal is a current signal whose level increases over time in a period and is then reset to a predefined value in the period for each period of a plurality of periods in accordance with an operation cycle of the transistor.

9. The apparatus of claim 7, wherein, if the combined current is equal to or greater than the reference current, the control signal output unit outputs an off control signal which turns off the transistor, and the control signal output module outputs an on control signal at each on period of a plurality of on periods of the clock signal which turn on the transistor.

10. A method of controlling an LED driving circuit, the method comprising:

generating a clock signal for periodically driving a transistor in the LED driving circuit;

generating an additional signal that is in synchronization with the clock signal;

receiving the additional signal and a current that is used in the LED driving circuit;

adding the additional signal and the current that is used in the LED driving circuit to generate a combined current;

comparing the combined current with a reference current; and outputting a control signal for controlling the transistor based on a result of the comparing.

11. The method of claim 10, wherein the additional signal is a current signal whose level increases over time in a period and is then reset to a predefined value in the period for each period of a plurality of periods in accordance with an operation cycle of the transistor.

12. The method of claim 10, wherein, if the combined current is equal to or greater than the reference current, outputting the control signal which turns off the transistor until the next on period of the clock signal.

* * * * *